US011226167B2

(12) United States Patent
Thalberg

(10) Patent No.: US 11,226,167 B2
(45) **Date of Patent: *Jan. 18, 2022**

(54) TENSION AMPLIFYING ASSEMBLY AND METHOD FOR ARCHERY BOWS

(71) Applicant: Krysse AS, Oslo (NO)

(72) Inventor: Anders Thalberg, Hafslundsoey (NO)

(73) Assignee: Krysse AS, Oslo (NO)

( * ) Notice: Subject to any disclaimer, the term of this patent is extended or adjusted under 35 U.S.C. 154(b) by 0 days.

This patent is subject to a terminal disclaimer.

(21) Appl. No.: 16/919,698

(22) Filed: Jul. 2, 2020

(65) Prior Publication Data

US 2020/0333102 A1 Oct. 22, 2020

Related U.S. Application Data

(63) Continuation of application No. 16/317,645, filed on Jan. 15, 2019, now Pat. No. 10,724,821.

(51) Int. Cl.
*F41B 5/14* (2006.01)
*F41B 5/10* (2006.01)

(52) U.S. Cl.
CPC ..... *F41B 5/1403* (2013.01); *F41B 5/10* (2013.01); *F41B 5/14* (2013.01)

(58) Field of Classification Search
CPC ..... F41B 5/00; F41B 5/12; F41B 5/14; F41B 5/1403; F41B 5/1469; F41B 5/10
(Continued)

(56) References Cited

U.S. PATENT DOCUMENTS 3,028,851 A 4/1962 Drake
3,744,473 A 7/1973 Nishioka
(Continued)

FOREIGN PATENT DOCUMENTS

AT A 50658/2016 11/2017
CA 1122865 A 5/1982
(Continued)

OTHER PUBLICATIONS

PCT/NO2017/000019; filed Jul. 14, 2017; International Search Report and Written Opinion dated Nov. 1, 2017 (11 pages).
(Continued)

*Primary Examiner* — Alexander R Niconovich
(74) *Attorney, Agent, or Firm* — Barclay Damon LLP

(57) ABSTRACT

A tension amplifying assembly and method are disclosed herein. The tension amplifying assembly, in an embodiment, includes a plurality of connection points or connection members configured to be coupled to a structure of an archery bow. Each of the connection members is configured to movably couple one of the limbs to the structure so that each of the limbs is movable from a first position relative to the structure to a second position relative to the structure. The tension amplifying assembly also includes a plurality of piston-cylinder assemblies, at least one reservoir tillable with a fluid, at least one valve, and a switch device configured to be operatively coupled to the at least one valve. The connection members are configured to cause the limbs to move from the first positions to the second positions in response to an operation of the switch device, and the movements cause the tension in the bow string to increase.

20 Claims, 10 Drawing Sheets

(58) Field of Classification Search
USPC ..... 124/25.6, 25, 86
See application file for complete search history.

(56) References Cited

U.S. PATENT DOCUMENTS 3,812,835 A 5/1974 Smith
3,957,027 A 5/1976 Drake
4,054,118 A 10/1977 McKee et al.
4,103,667 A 8/1978 Shepley
4,169,456 A 10/1979 Van House
4,183,345 A 1/1980 Caldwell
4,187,826 A 2/1980 Killian
4,201,182 A 5/1980 Butler
4,227,509 A 10/1980 Jones
4,287,867 A 9/1981 Islas
4,350,138 A 9/1982 Caldwell
4,478,202 A 10/1984 Anderson
4,512,326 A 4/1985 Jarrett
4,644,928 A 2/1987 Studanski
4,646,708 A 3/1987 Imes
4,649,891 A 3/1987 Bozek
4,671,249 A 6/1987 Troncoso
4,672,943 A 6/1987 Bozek
4,712,533 A 12/1987 Cruise
4,756,295 A 7/1988 Guzzetta
4,781,168 A 11/1988 Lester
4,858,588 A 8/1989 Bozek
4,955,354 A 9/1990 Bozek
4,989,577 A 2/1991 Bixby
5,125,389 A 6/1992 Paff
5,205,269 A * 4/1993 Guzzetta ..... F41B 5/0094 124/23.1
5,220,906 A 6/1993 Choma
5,280,779 A 1/1994 Smith
5,388,564 A 2/1995 Islas
5,429,106 A 7/1995 Martin et al.
5,445,139 A * 8/1995 Bybee ..... F41B 5/12 124/23.1
5,657,739 A 8/1997 Smith
5,720,267 A 2/1998 Walk
5,749,348 A 5/1998 Oviedo-Reyes
5,931,146 A * 8/1999 Schrader ..... F41B 5/0052 124/23.1
5,979,425 A 11/1999 Loomis
6,024,076 A 2/2000 Laborde
6,286,496 B1 9/2001 Bednar
6,470,870 B1 10/2002 Schaar
6,990,970 B1 1/2006 Darlington
7,201,161 B1 4/2007 York
7,204,242 B2 4/2007 Dziekan
7,568,372 B1 8/2009 Patton
7,699,045 B1 4/2010 Kronengold et al.
7,740,011 B1 6/2010 Bernardy
7,784,452 B1 8/2010 Kronengold et al.
8,191,541 B2 6/2012 Shaffer et al.
8,240,075 B1 8/2012 Mullin
8,240,299 B2 8/2012 Kronengold et al.
8,387,603 B2 3/2013 Darlington
8,439,025 B2 5/2013 Shaffer et al.
8,453,631 B1 6/2013 Kronengold et al.
8,469,012 B2 6/2013 Bednar et al.
8,651,095 B2 2/2014 Islas
8,763,595 B1 7/2014 Bednar et al.
8,794,225 B2 8/2014 Bednar et al.
8,899,217 B2 12/2014 Islas
9,086,249 B2 7/2015 Peacemaker et al.
9,140,281 B1 9/2015 Schaar
9,234,719 B1 1/2016 Kempf
9,243,861 B1 1/2016 Kempf
9,255,753 B2 2/2016 Pulkrabek et al.
9,255,757 B2 2/2016 McPherson
9,255,759 B1 2/2016 Archer
9,273,922 B2 * 3/2016 Hudkins ..... F41B 5/123
9,291,421 B1 3/2016 Kempf
9,354,015 B2 5/2016 Yehle
9,377,267 B1 6/2016 Kempf
9,383,159 B2 7/2016 Pulkrabek et al.
9,494,379 B2 11/2016 Yehle
9,494,380 B1 11/2016 Yehle
9,506,716 B2 11/2016 Bednar et al.
9,513,080 B1 12/2016 Kempf et al.
9,557,134 B1 1/2017 Yehle
9,689,638 B1 6/2017 Yehle
9,851,171 B2 12/2017 Bednar et al.
9,863,735 B2 1/2018 Bednar et al.
9,879,936 B2 1/2018 Yehle
9,879,938 B1 1/2018 Isenhower et al.
9,933,225 B2 4/2018 Yehle et al.
10,018,443 B2 7/2018 Dziekan
10,077,965 B2 9/2018 Yehle
10,082,359 B2 9/2018 Yehle
10,126,088 B2 11/2018 Yehle
10,139,205 B2 11/2018 Yehle et al.
D836,743 S 12/2018 Yehle
D838,477 S 1/2019 Hedberg
D839,374 S 1/2019 Yehle
10,175,023 B2 1/2019 Yehle
10,203,186 B2 2/2019 Yehle et al.
10,209,026 B2 2/2019 Yehle
10,254,073 B2 4/2019 Yehle
10,254,075 B2 4/2019 Yehle
10,260,835 B2 4/2019 Pulkrabek et al.
10,267,592 B2 4/2019 Bartels
10,323,899 B2 6/2019 Missbach et al.
10,359,254 B1 7/2019 Kempf et al.
10,378,852 B1 * 8/2019 Rotramel ..... F41B 5/00
10,408,558 B2 9/2019 Thalberg
10,458,743 B1 10/2019 Kempf et al.
10,598,460 B1 * 3/2020 Peacemaker ..... F41B 5/1411
10,712,118 B2 7/2020 Yehle
10,724,821 B2 7/2020 Thalberg
11,009,311 B2 * 5/2021 Peacemaker ..... F41B 5/10
2004/0094139 A1 5/2004 Andrews
2004/0194771 A1 10/2004 Malucelli
2005/0139200 A1 6/2005 Gallops
2006/0011181 A1 1/2006 Andrews
2007/0089722 A1 * 4/2007 Flanagan ..... F41B 5/14 124/23.1
2007/0119438 A1 5/2007 Pittman
2008/0127961 A1 6/2008 McPherson
2009/0064978 A1 3/2009 Matasic et al.
2009/0101126 A1 4/2009 Anderson
2010/0308508 A1 12/2010 Gertitschke et al.
2011/0120436 A1 * 5/2011 Eee ..... F41B 5/10 124/25.6
2011/0022085 A1 9/2011 Christensen et al.
2011/0308508 A1 12/2011 Islas
2012/0192843 A1 8/2012 Bardorf
2012/0222663 A1 * 9/2012 Nebergall ..... F41B 5/10 124/25.6
2013/0061839 A1 3/2013 Asherman
2013/0312724 A1 * 11/2013 Hudkins ..... F41B 5/123 124/25
2014/0261355 A1 * 9/2014 Peacemaker ..... F41B 5/1403 124/23.1
2014/0261356 A1 9/2014 Peacemaker
2014/0261360 A1 9/2014 Pulkrabek
2014/0352678 A1 12/2014 Howard
2016/0010943 A1 1/2016 DeBole
2017/0108307 A1 4/2017 Yehle
2018/0051955 A1 2/2018 Yehle
2018/0094895 A1 4/2018 Yehle
2018/0321010 A1 11/2018 Yehle
2018/0321011 A1 11/2018 Yehle
2019/0025004 A1 * 1/2019 Thalberg ..... F41B 5/1469
2019/0025005 A1 1/2019 Shaffer et al.
2019/0128637 A1 * 5/2019 Missbach ..... F41B 5/12
2019/0137212 A1 5/2019 Yehle
2019/0137245 A1 5/2019 Yehle et al.
2019/0154392 A1 5/2019 Yehle
2019/0186863 A1 6/2019 Yehle
2019/0186865 A1 6/2019 Pulkrabek et al.
2019/0226793 A1 7/2019 Thalberg

(56) References Cited

U.S. PATENT DOCUMENTS

| | | | |
|---|---|---|---|
| 2019/0242671 | A1 | 8/2019 | Bartels |
| 2019/0376761 | A1 | 12/2019 | Thalberg |
| 2020/0049446 | A1 | 2/2020 | Thalberg |

FOREIGN PATENT DOCUMENTS

| | | | |
|---|---|---|---|
| CA | 2481600 | | 6/2010 |
| CN | 202928451 | U | 5/2013 |
| DE | 3502617 | C2 | 1/1985 |
| EP | 0029866 | B1 | 6/1981 |
| KR | 20110058373 | A | 6/2011 |
| NO | 20161182 | A1 | 1/2018 |
| WO | 2018/014062 | A1 | 1/2018 |
| WO | 2018012982 | A1 | 1/2018 |
| WO | 2019017798 | A1 | 1/2019 |

OTHER PUBLICATIONS

PCT/NO2018/050195; filed Jul. 18, 2018; International Search Report and Written Opinion dated Oct. 30, 2018 (6 pages).
NO20161182; filed Jul. 15, 2016; Norwegian Search Report dated Dec. 23, 2016 (2 pages).
EP17828029; filed Jul. 14, 2017; Supplementary European Search Report, dated Feb. 7, 2020 (2 pages).
Hunt Hacks; How to Set the Draw Weight on a Compound Bow; Jul. 4, 2016; retrieved for https://huthacks.com/set-draw-weight-compound-bow/ (6 pages.).
Parker Bows; Concorde; Dated Jul. 10, 2011; Retrieved from the Internet: <https//www.youtube.com/watch?v=bNq6Dp3-CuY> (5 pages).
Bauserman, Jace; Market Trends, Crossbow Report; Parker Concorde; Inside Archery; on or before May 31, 2011 (2 pages).
Krysse AS; Norway Application No. NO20191134; filed Sep. 19, 2019.
Krysse AS; Norway Application No. NO20191134; filed Sep. 19, 2019; NO Search Report; dated Mar. 30, 2020 (2 pages).
Krysse AS; Norway Application No. NO20161182; filed Jul. 15, 2016; Norwegian Search Report dated Dec. 23, 2016 (2 pages).
Krysse AS; Norway Application No. NO20200033; filed Jan. 10, 2020.
Krysse AS; Norway Application No. NO20200143; filed Feb. 4, 2020.
Krysse AS; Norway Application No. NO20200299; filed Mar. 11, 2020.
Oneida Eagle; On or before Dec. 31, 1993 ( 1 page).
Tenpoint and Ravin Crossbows; On or before Sep. 12, 2019 (2 pages).
"Oneida Eagle Bows"; Oneida Eagle Bows; Jul. 5, 2017; retrieved from the Internet: <https://web.archive.org/web/20170705202203/http://oneidaeaglebows.com/#>; (1 page).
Rick Combs; "Bow Report on Oneida Kestrel"; Grand View Outdoors; Nov. 1, 2013; retrieved from the Internet: <https://www.grandviewoutdoors.com/bowhunting/bow-report-oneida-kestrel>; (5 pages).
Parker Concorde; Crossbow Report; Jace Bauserman; Inside Archery; on or before May 30, 2011 (2 pages).

* cited by examiner

TENSION AMPLIFYING ASSEMBLY AND METHOD FOR ARCHERY BOWS

CROSS-REFERENCE TO RELATED APPLICATIONS

This application is a continuation of, and claims the benefit and priority of, U.S. patent application Ser. No. 16/317,645 filed on Jan. 15, 2019, which is a national stage application pursuant to 35 U.S.C. § 371 of International Application No. PCT/N02017/000019 filed on Jul. 14, 2017, which claims priority to, and the benefit of, Norwegian Patent Application No. 20161182 filed on Jul. 15, 2016. The entire contents of such applications are hereby incorporated by reference.

The present invention relates to compound bow constructions and power assisted draw weight amplifier and a method for retrofitting power assisted draw weight amplifier to a compound bow.

BACKGROUND

Drawing a compound bow is associated with a high initial draw weight, a distinct let off when the bow string is fully drawn, and if the arrow is not released in a shot, then the relieve phase is also associated with a high draw weight. The key advantage of a compound bow is the let off phase of the draw, letting the archer hold the bow at full draw with only the need to exert a fraction of the launch force. There is a problem for archers not having the strength to exercise the required power to draw a bow configured for fulfilling the requirements for being used in a hunting situation.

The history has provided a number of attempts that have attempted to solve the stated problem by providing methods and devices for increasing the draw force in a bow, including crossbow, archery bow, and compound bow, attempting to improve power, range, speed and accuracy. This has been achieved either by greater exertion of force by the archer pulling the string, or mechanical devices providing extra pull force, once the string has been drawn by the user. Common for the mechanical devices provided is that they all face problems in one or more aspects such as: the bow assembly being too heavy, being too difficult to use, exhibits noise and vibration levels above acceptable values, or simply is not efficient enough.

SUMMARY

The above problems are particularly undesired in a hunting environment, and it has not been possible to apply the mentioned mechanical devices fulfilling the requirements to a compound bow used in hunting environments.

At present, in most countries where bow hunting is an allowed hunting art, there are defined requirements to the power of a bow allowed to be used for hunting. Thus, in practice it is a minimum strength required for a person wanting to participate in bow hunting, in order for the person to be able to operate an allowable bow. This requirement to the hunter strength disqualifies a lot of persons for taking active part in bow hunting. Specifically youths, females, disabled and elderly people find that they are not able to fulfill the minimum requirements.

Present invention provides solutions to the above stated objective technical problems, and is particularly directed to a compound bow, but could also be modified to work on other types of bow equipment.

The present invention provides a bow which enables a person to be able to fulfill the minimum power required for hunting, allowing persons of less strength to operate the bow, specifically youths, females, disabled and elderly people that are not able to fulfill the minimum power requirements set by regulations. The invention is also a tool for bow users able to draw he required force, but who need additional power for adding extra speed or arrow weight capacity. Typically for long distance shooting or big game hunting, the normal minimum bow capacities are not adequate. In such use cases there is a need for being able to add extra power to the bow.

The present invention further provides devices for increasing the bow force relative to the required draw force, further comprising low weight, high power, low vibration, easy operation and low noise. Further features of the present invention comprise a bow assembly which is easy to manage and maintain for repeated action.

In one embodiment of the invention, pneumatic driven cylinders mounted inside the riser construction provides additional power to power assisted draw weight amplifier devices arranged to exert a pulling force on the limb bolts of bottom and top limb.

In another embodiment of the invention, worm gears and electric motors which are mounted inside the riser construction provides additional power to power assisted draw weight amplifier devices arranged to exert a pulling force on the limb bolts of bottom and top limb.

In yet another embodiment of the invention, linear actuators which are mounted inside the riser construction provides additional power to power assisted draw weight amplifier devices arranged to exert a pulling force on the limb bolts of bottom and top limb.

The invention further comprises a switch device connected to the power assisted draw weight amplifier devices that exert a pulling force on the limb bolts of bottom and top limb. The switch device being able to activate and deactivate the power assisted draw weight amplifier devices that exert a pulling force on the limb bolts of bottom and top limb.

The invention further comprises a pneumatic or electrical accumulator/source to provide pressure or power to the power assisted draw weight amplifier devices that exert a pulling force on the limb bolts of bottom and top limb.

The invention is further described by examples of embodiments in the attached drawings and the protection scope is defined by the independent claims. Further advantageous embodiments are defined in the dependent claims.

DETAILED DESCRIPTION

Figure 1:
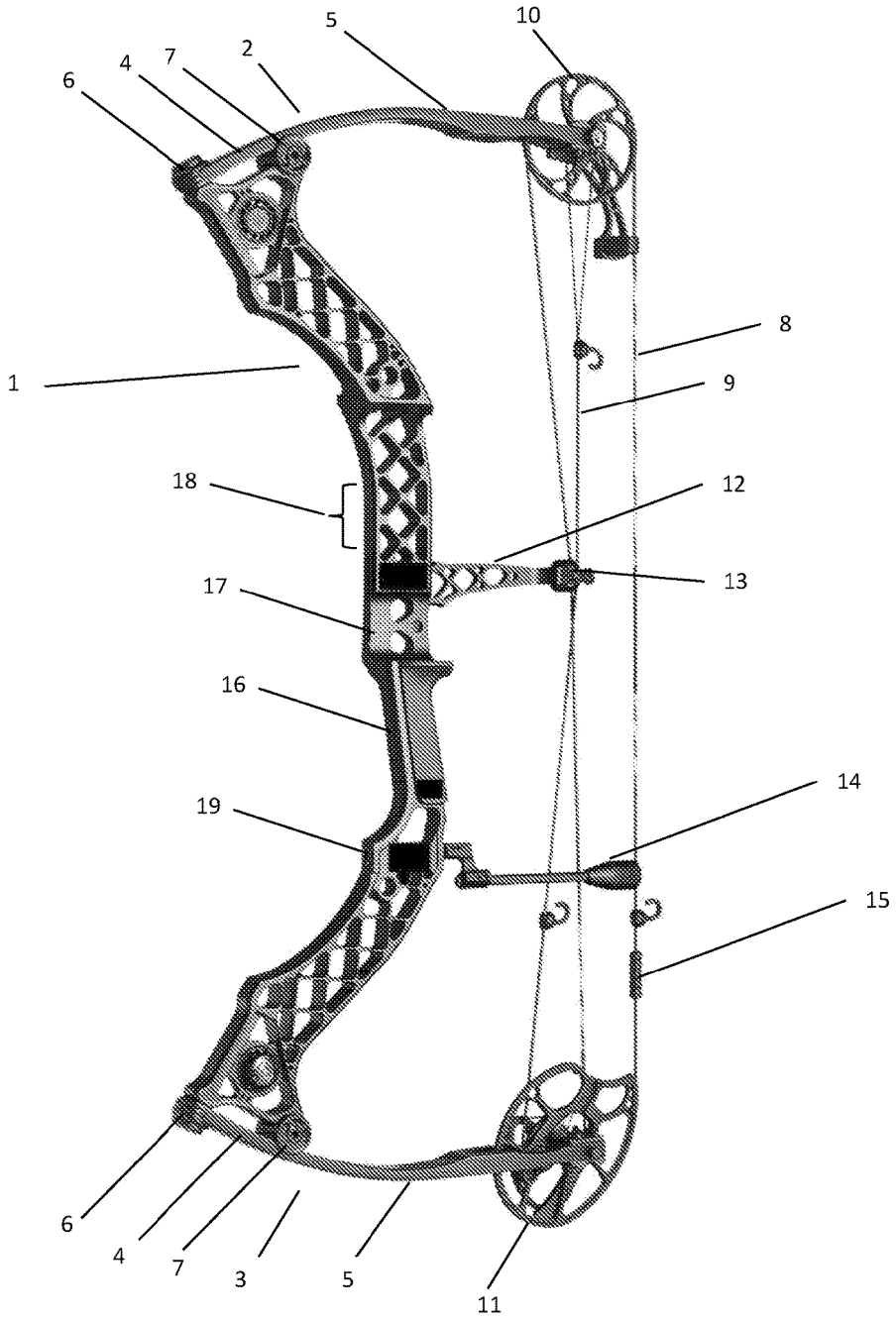
FIG. 1—Prior art compound bow construction

The present invention will now be described in more detail with reference to the non limiting drawings.

It shall be understood that the embodiments only describe the principle of the invention, and that there may be additional ways to implement the present invention. It is the associated claims that shall define the protection scope of the present invention.

The invention comprise a power assisted draw weight amplifier assembly 20 connected to the adjustable limb bolt 6 controlling the tension in at least both top and bottom limb 2, 3. The at least two power assisted draw weight amplifier assemblies 20 comprise an actuator connected to an energy resource/storage 81, such as a pressurized gas container, via supply lines 38,39,40, such as air hoses, connecting, gas communication wise, the power assisted draw weight amplifier assemblies 20 with the energy resource 81 via a valve/controller 80 and switch device 82.

The actuator may be comprised of a pneumatic cylinder 33/piston 22 using compressed gas/air (or vacuum) at high pressure, a hydraulic actuator comprising a fluid motor using hydraulic power, magnetic solenoids or the like using permanent magnets or electro magnets, or mechanical gear solution using an electromotor 86 and an energy resource such as a battery 83. In the latter case the supply lines 38, 39, 40 will be constituted of electrical wiring. All actuators will use an energy reservoir, being one of pressurized gas or fluid stored or created in for example a pressure container 81, or electrical energy stored in for example a battery 83.

Figure 2:
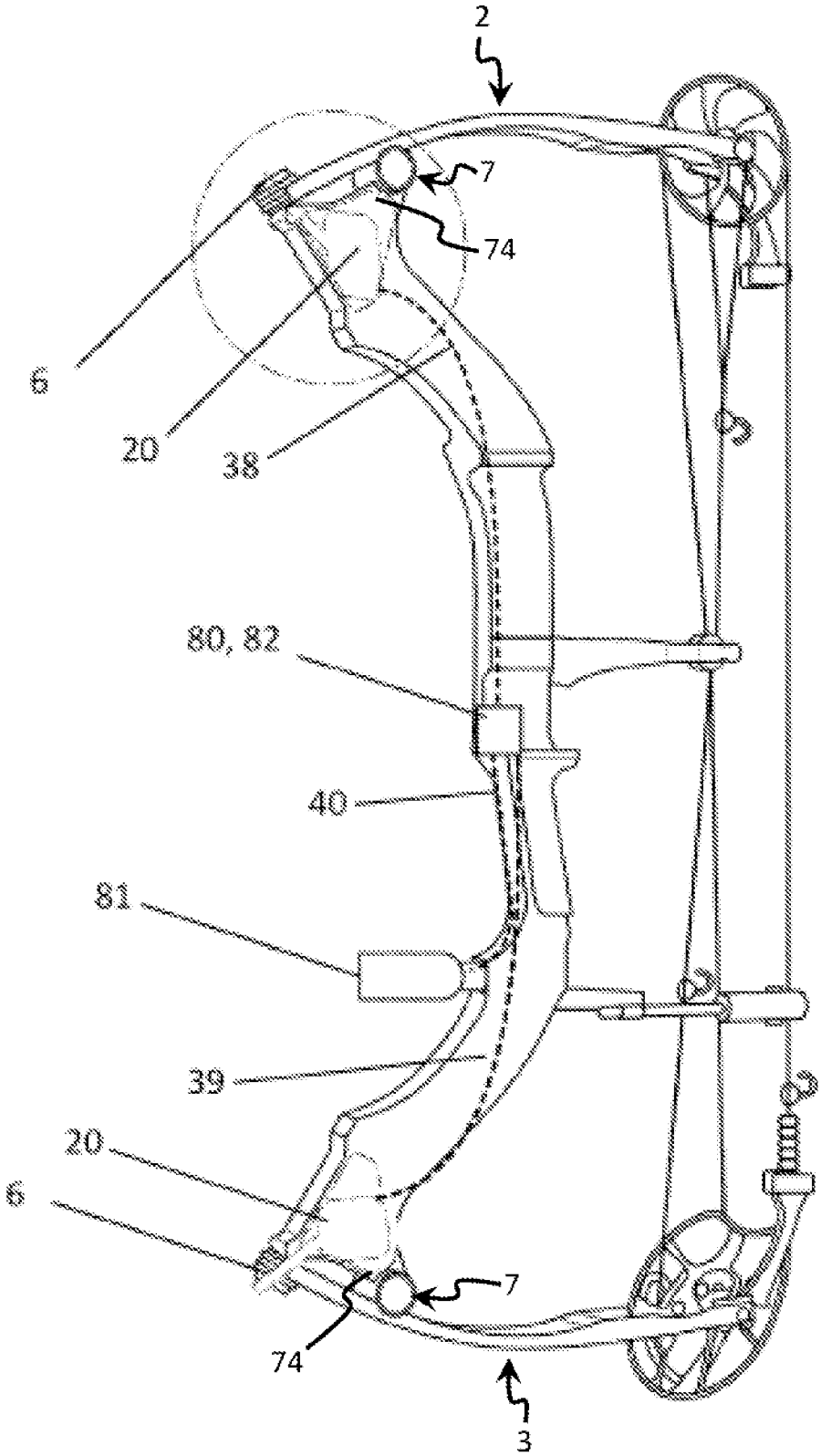
FIG. 2—Power assisted draw weight amplifier conceptual sketch
Figure 3:
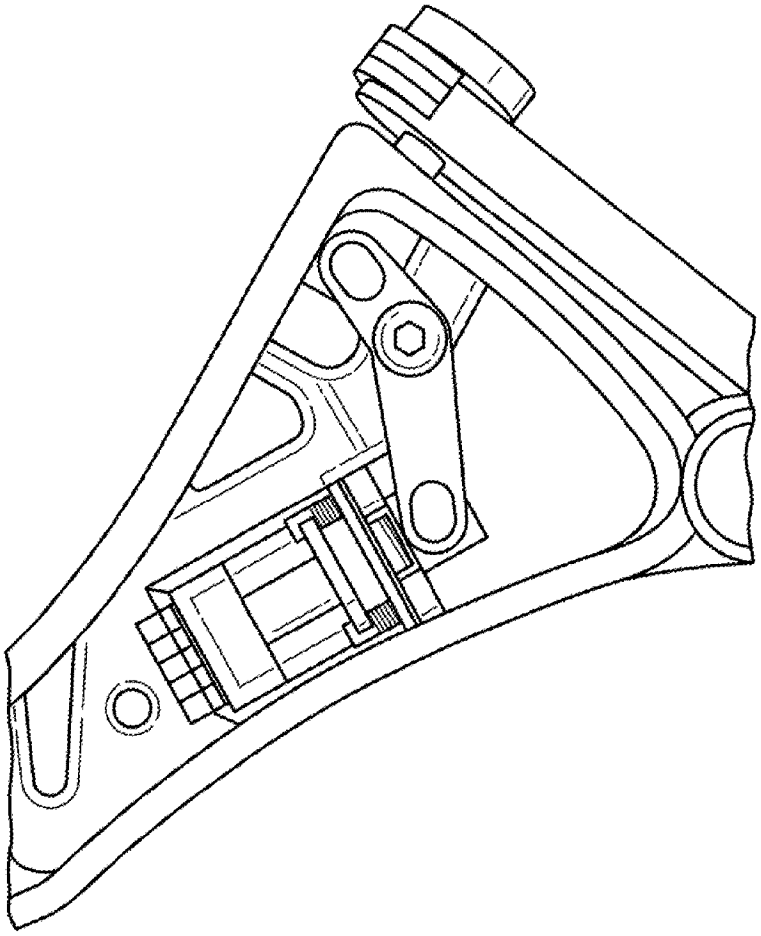
FIG. 3—Detailed example of a pneumatic driven power assisted draw weight amplifier device FIG. 4—Power assisted draw weight amplifier assembly FIG. 5—Worm gear actuator FIG. 6—Linear actuator FIG. 7—Spindle/screw actuator FIGS. 8A, 8B and 8C—Valve and/or switch operation FIG. 9—Alternative embodiment of power assisted draw weight amplifier device
Figure 4:
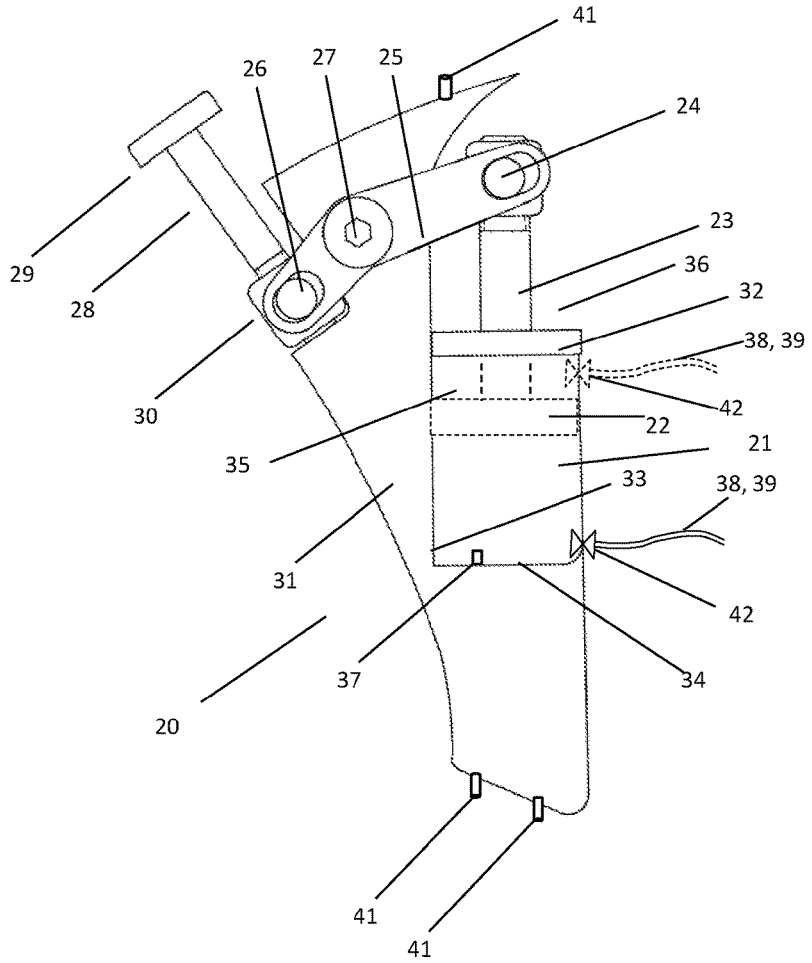

One embodiment of the invention is described in FIG. 2-4.

The power assisted draw weight amplifier assembly 20 is arranged on both the upper end and bottom end of the riser 1. The power assisted draw weight amplifier assembly 20 is typically integrated into the riser 1 construction/frame. Although it is possible to retrofit the power assisted draw weight amplifier assembly 20 to existing compound bows, it will require cutting and custom fitting to achieve a stable and solid solution. The invention may be implemented included by the manufacturer of the bow riser or fitted to half fabricate bows which are prepared specifically for being fitted with the power assisted draw weight amplifier assembly 20 according to the invention. It is an option for the manufacturer to produce a dummy frame in the portion of the riser intended for the power assisted draw weight amplifier assembly 20, in order for the bow to be operational and stable even if the power assisted draw weight amplifier assembly 20 is not immediately installed.

Figure 8A:
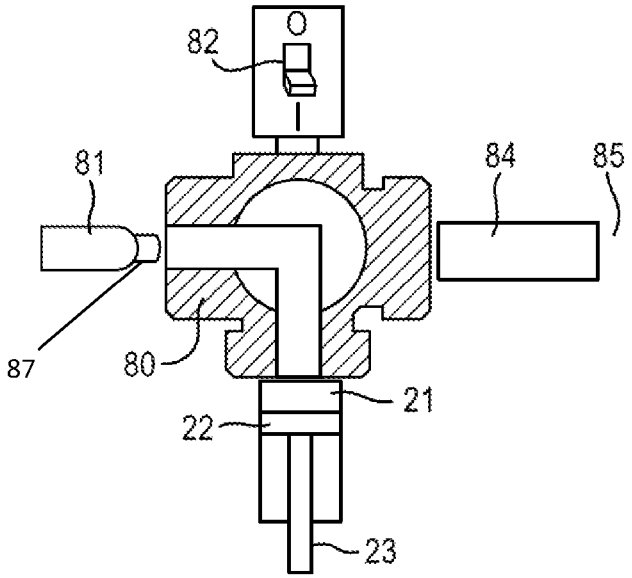
Figure 8B:
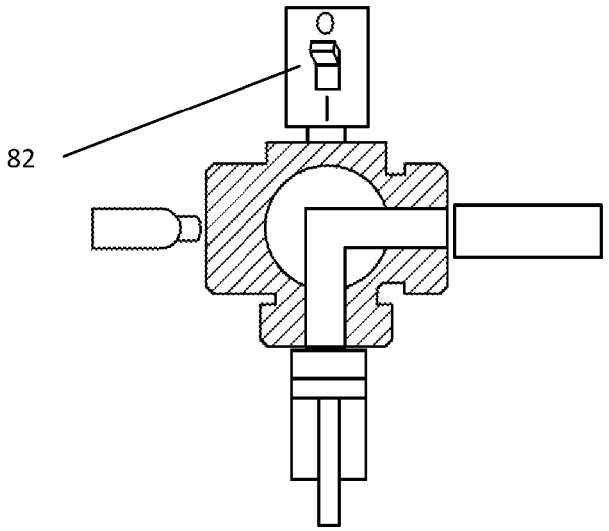

The power assisted draw weight amplifier 20 in FIGS. 2 and 4 is comprised by a pneumatic piston 22—cylinder 33 assembly. The piston 22—cylinder 33 assembly 36 is comprised by a piston 22 arranged in a cylinder 33, wherein a pressure chamber 21 is defined by the piston head 22 surface and the cylinder side 33 and bottom wall 34. The cylinder 33 may further be enclosed by a cylinder top 32, wherein the cylinder top 32 comprises a conduit through which a piston rod 23 is arranged. The pressure chamber 21 is in pneumatic gas communication, via a gas/air hose 38, 39, 40, through a conduit 42 in the cylinder bottom wall 34 or lower part of the cylinder wall 33, with a pressurized gas reservoir 81. A valve 80, as shown in FIG. 8A, between the gas reservoir 81 and the pressure chamber 21 controls the transfer of gas between the gas reservoir 81 and the air hose 38, 39 connected to the pressure chamber 21, and between the pressure chamber 21 via the air hose 38, 39 and a pressure relief reservoir 85. The pressure relief reservoir 85 may be comprised by the surrounding "free air". The power assisted draw weight amplifier 20 further comprise a lever/actuator arm 25, 26, 27 wherein the lever arm 25, 26, 27 is arranged to transfer the force generated by the expanding pressure chamber 21 to the limb bolt 6, 28 in a way that when the pressure chamber 21 is expanded the piston rod 23 connected to the moving piston 22 will pivot the lever arm with the effect that the attached the limb bolt 6, 28 is drawn towards the Bow riser 1, the limb bolt head 29 is arranged on the top side of the top or bottom limb 2, 3, and the pulling force on the limb bolt is translated to an increase in the tension in the top and bottom limb 2, 3 and the bow string 8, and hence the draw weight is increased.

The valve 80 may be manually or electrically adjustable for adjusting gas pressure output level, and may additionally comprise an adjustable output gas volume regulator for controlling the output gas flow speed and/or the amount of gas volume outputted from the valve each time the switch 82 is operated to activate a gas feed cycle.

In one embodiment of the invention the lever arm 25, 26, 27 comprise a resistance arm 26, an effort arm 25 and a fulcrum 27. In a first outer end of the lever arm, the effort arm 25 is connected to a first end 24 of a piston rod 23 which in its opposite second end is connected to the piston 22. In the other second end of the lever arm, the resistance arm 26 is connected to the limb bolt base 30 of the limb bolt 28. The lever arm rotates around a fulcrum 27 (pivot point) such that when the pressure in the pressure chamber 21 increases, the effort arm 25 is moved away from the pressure chamber 21 by the piston 22 and piston rod 23, and the resistance arm 26 will act on the limb bolt base 30 and exert a pulling force on the limb bolt 28, 6. The ratio between the effort arm and the resistance arm defines the force amplification from the force applied by the cylinder rod effective on the limb bolt.

$$F\text{limbbolt}=(L\text{effort}/L\text{resistance})*F\text{cylinderrod}$$

In a further embodiment of the invention, the cylinder 33, piston 22 and piston rod 23 may be coupled directly to the limb bolt 6, 28. The pressure chamber 35 for the cylinder will then be at the opposite side of the piston 22, namely on the side of the piston rod 23. The cylinder side wall 33 will be similar as the above example, but the cylinder top 32 comprise an air tight conduit for the piston rod/actuator arm 23 to be arranged inside, the piston rod 23 protruding outside the cylinder 33 and is directly connected to the limb bolt 6, 28. In this embodiment the cylinder will be open on the side 21 of the piston not being connected to the piston rod, the opening has atmospheric pressure by an opening in—or absence of—the cylinder bottom wall 34. In this embodiment there will be no amplification of the force applied to the limb bolt 6, 28 by the pressure increase in and expansion of the pressure chamber 35, hence the gas pressure supplied to the power assisted draw weight amplifier assembly 20 is higher. Therefore, also a more robust design is provided. The design is further adapted to the reduced piston surface area as a result of the piston rod being mounted on the active piston surface side. The size of the cylinder and piston is adapted correspondingly to be able to execute the required force on the limb bolt. A corresponding conduit 42 and pressure gas/air hose 38, 39 (drawn in dotted line in FIG. 4) will be arranged in either the cylinder top 32 or in the cylinder wall 22 close to the cylinder top 32.

The above described embodiments are both pneumatic pressure chamber devices, and the energy storage 81 is comprised by a pneumatic accumulator. A pressure pipe/air hose connects the pneumatic accumulator 81 to the power assisted draw weight amplifier assemblies 20 via a pipe/air hose 38, 39, 40. The connection further comprises a valve 80 for controlling the gas flow through the pressure pipe/air hose 38, 39, 40 such that the pressure chamber 21,35 of the power assisted draw weight amplifier assemblies 20 is in pneumatic communication with the pneumatic accumulator 81. The valve 80 may further be functioning as a pressure reduction valve (not shown), since the pressure in the accumulator 81 normally is much higher than what is required by the power assisted draw weight amplifier assemblies 20 to work. This is the case at least when the pneumatic accumulator is fully charged. The pneumatic accumulators 81 may be replaceable and/or rechargeable. Although the accumulator may be arranged in any place on the bow assembly, it is advantageously to arrange it in a location where it will influence as little as possible on weight balance and resonance of the bow operation. Many compound bows will have a threaded connection point 19 for example a stabilizer, camera or a light source close to the grip section. It is possible to use this connection point 19 for the pneumatic accumulator 81 or one similar in the same area. It is also within the scope of the invention to add features to the accumulator such that when it is mounted to the bow, it could for example additionally serve as camera, extra stabilizing weight, light and other.

In a further embodiment of the invention, the valve 80, reduction valve and for example a silencer 84 may all be comprised in a attachable pneumatic accumulator assembly. In such an embodiment the elements of the invention comprised in the bow may be fewer, hence cheaper and faster to produce, and easier to maintain. The pneumatic accumulator assembly may be comprised of individual parts assembled before being mounted to the bow. A pneumatic accumulator assembly consisting of individual mountable/exchangeable parts such as pneumatic accumulator 81, reduction valve 87 and silencer/muffler 84 may be advantageous since there is a difference in lifespan of the different parts, which means they require replacement at different intervals. The valve 80 has a much longer lifetime then the silencer/muffler 84, which again has a longer lifetime than the pneumatic accumulator 81.

In yet another embodiment, the pneumatic accumulator 81 is connected directly to a connection point 19 in the riser, the valve 80 is integrated in the bow riser design close or directly to the pneumatic accumulator 81 connection point 19 and a silencer 84 may be connected directly to the valve 80 output connection point. If the reduction valve 87 is separate from the valve itself, the reduction valve 87 can be arranged between the valve 80 and the pneumatic accumulator 81, either outside the bow construction, as a separate connectable reduction valve device 87 connected to the connection point 19 on the riser 1, or as a reduction valve 87 integrated in the pneumatic accumulator 81.

The valve 80 controls the flow of pressurized gas/air from the accumulator 81 to the power assisted draw weight amplifier assemblies 20, and may be manually operated. In one embodiment of the invention the valve is controlled by a switch 82 arranged close to the bow grip 16, such that it can be operated by the user in the draw cycle of the bow string 8. The switch 82 controls the valve. When the bow string 8 is in the draw phase, and the pressure in the pressure chamber 21, 35 of the power assisted draw weight amplifier assemblies 20 is not pressurized (atmospheric pressure), the switch 82 will, when operated, set the valve 80 in a state where pressurized gas flows from the accumulator 81 to the pressure chamber 21, 35. In the case the pressure chamber 21, 35 is pressurized (above atmospheric pressure e.g. 3-13 bar), and the switch 82 is operated, the switch 82 may set the valve 80 in a relieve state where pressurized gas in the pressure chamber 21, 35 will be let out into a pressure relief reservoir 85, wherein the pressure relief reservoir which in the case of using gas is the environment (free air). In one embodiment the valve 80 therefore has at least 3 states:

TABLE I

| State | Pressure chamber | Accumulator | Relief reservoir |
|---|---|---|---|
| Initial state | ○ | X | ○ |
| Load | ○ | ○ | X |
| Relieve | ○ | X | ○ |

○—open,
X—closed

The gas accumulator will be provided with a reduction valve 87 in those implementations where the accumulator pressure is higher than acceptable for the pipes/air hoses 38, 39, 40, and the valve 80 does not comprise such pressure reduction valve.

The outlet of the valve 80, whether it is to the environment or a confined space, the outlet is advantageously led through a connected silencer/muffler 84. The silencer/muffler 84 may be incorporated in the valve 80, or is attached to the valve 80 or attached to an extension tube (not shown) connected to the outlet of the valve 80.

The switch 82 may be operated between two or more positions, where each position uniquely defines a valve 80 and/or pressure mode. Another switch type offer only one operation mode (such as a push button) which may toggle the different modes of the valve.

It is within the scope of the invention to use a digital switch and an electrically powered valve. The switch may offer a display to identify the current state of the switch, and identify selectable switch modes.

When an arrow is released in a shooting cycle or the shooting cycle is aborted and the bow string is returned to its starting position and the switch 82 is arranged to be in the initial or relieve state, the cylinder 22 will move back to its initial position biased by the setup tension in the bow string and the limb arms.

The invention may comprise a display 75, such as for example an identification light, digital screen or electrical/non-electrical gauge/meter coupled to a sensor 37 inside the air hose and/or pressure chamber to identify the pressure status within the air hose and/or pressure chamber. For example can a green light be configured to identify that the pressure of the pressurized air in the hose and/or pressure chamber has reached the required pressure, and a red to identify that the pressure has returned to atmospheric pressure in the air hose and/or pressure chamber. Such identification light 75 should be directed towards the face position of the user in an active draw phase of the bow. It would be advantageous to use a low intensity light in order to minimize the risk that a game could be disturbed or warned by the light. In case the display 75 requires electrical power, at least a power source is incorporated in the display 75 or is attachable to external power source. The external power source may be the power accumulator 81.

It is further within the scope of the invention to arrange sensors 37 for detecting one or more of gas pressure, movement, temperature, and other parameters throughout the power assisted draw weight amplifier assembly. For example may a pressure sensor in the pressure chamber of the cylinder and/or a position sensor of the piston rod identify what state the piston is in, and in what pressure state the pressure chamber is.

A movement senor in a solenoid, linear actuator or worm gear may be used to identify their operation modus.

The sensor output may be displayed to the user via a display 75, and/or they may be stored in a storage device (not shown) which may be comprised in the display unit 75, for later transfer to a processing device for analysis. For example the output from sensors 37 may be used for maintenance and adjustment purposes. In one embodiment a wireless communication device may be connected to the sensors 37 for communicating the sensor data to a remote device. The communication may be in real time.

In one embodiment of the invention the implementation of the valve 80 is to be operated in a manual operation mode. Meaning it has to be actively switched between operation modes. The intention is that under operation of the bow, it is desirable to be able to activate the power assisted draw weight amplifier 20 after the bow string is fully drawn and when an arrow release is imminent. If arrow release is aborted or delayed, it is possible to switch the power assisted draw weight amplifier 20 to a relieve state which results in the extra tension to be reversed, and return the power assisted draw weight amplifier back to initial state. If the power assisted draw weight amplifier assemblies are constructed by worm gear, solenoid or linear actuator instead of a pneumatic cylinder, the piston rod/axel of worm gear or linear actuator is movable between at least two positions defining a bow string tension amplifying position, and a bow string non-tension amplifying position.

Figure 5:
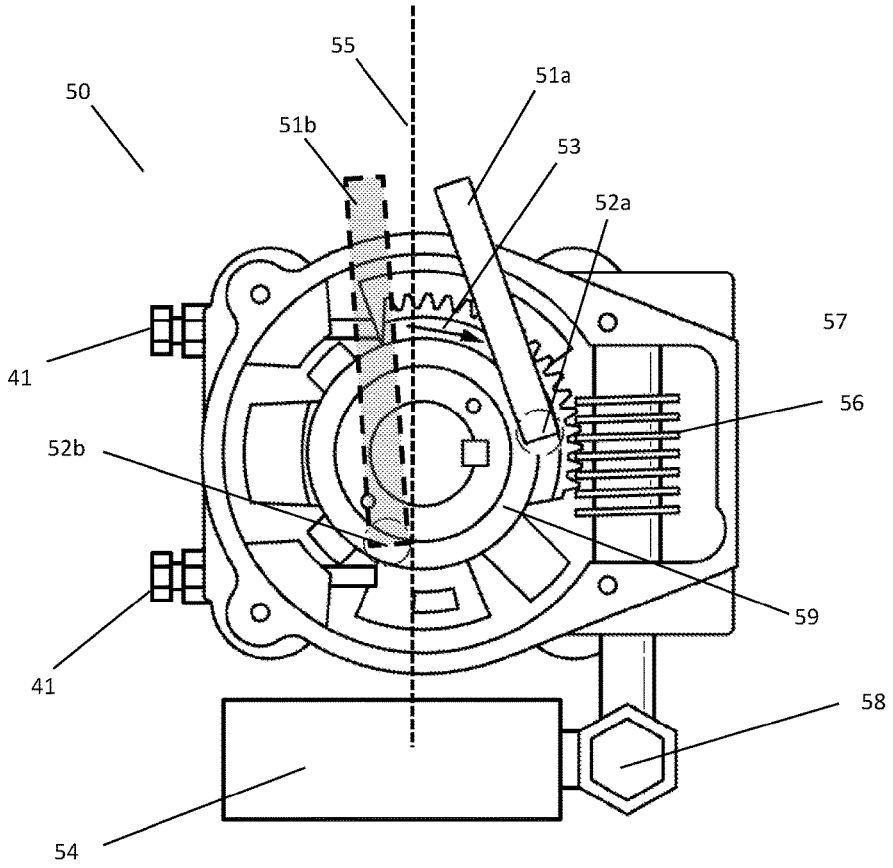

A worm gear 50 is illustrated in FIG. 5, which may be installed as the limb bolt tension amplifier 20 as shown in FIG. 2. The worm gear 50 comprises a limb bolt/limb bolt extension/actuator arm 51*a*, 51*b* which in the figure is illustrated in two alternative positions. The limb bolt extension 51*a*, 51*b* is an extension of the limb bolt 28, being connected to the limb bolt head 29 for moving the limbs 2, 3 in the region of the limb bolts 6. The solid line limb bolt extension 51*a* illustrates the position when the limb bolt is in a non-tension amplifying position, whilst the dotted line limb bolt extension 51*b* illustrates the position when the limb bolt is in a tension amplifying position. The worm gear 50 comprise a motor 54, the motor may be an electromotor, pneumatic motor or pneumatic digital motor, spring based motor or other. By applying a positive power to the motor 54, the force from the motor 54 is transferred to the threaded rod 56 via a gear 58, and drives the gear wheel 59, interacting with the sprocket teeth to move the limb bolt extension 51*a*, 51*b* from a first position to a second position. When reaching the second position the worm gear rotation will be stopped by a physical stopper (not shown). The second position is arranged to be at the return side of the center line 55 of the gear wheel 59. In this way when the limb bolt extension 51*b* is the tension amplifying position, the second position, the reverse tension force from the limb arm will ensure that the limb bolt extension 51*b* will remain in the tension position on the return side of the center line 55 of the gear wheel 59 until the worm gear actively drives the limb bolt extension 51*a*, 51*b* towards the non-tension position by reversing the action of the worm gear, by applying negative force.

Figure 6:
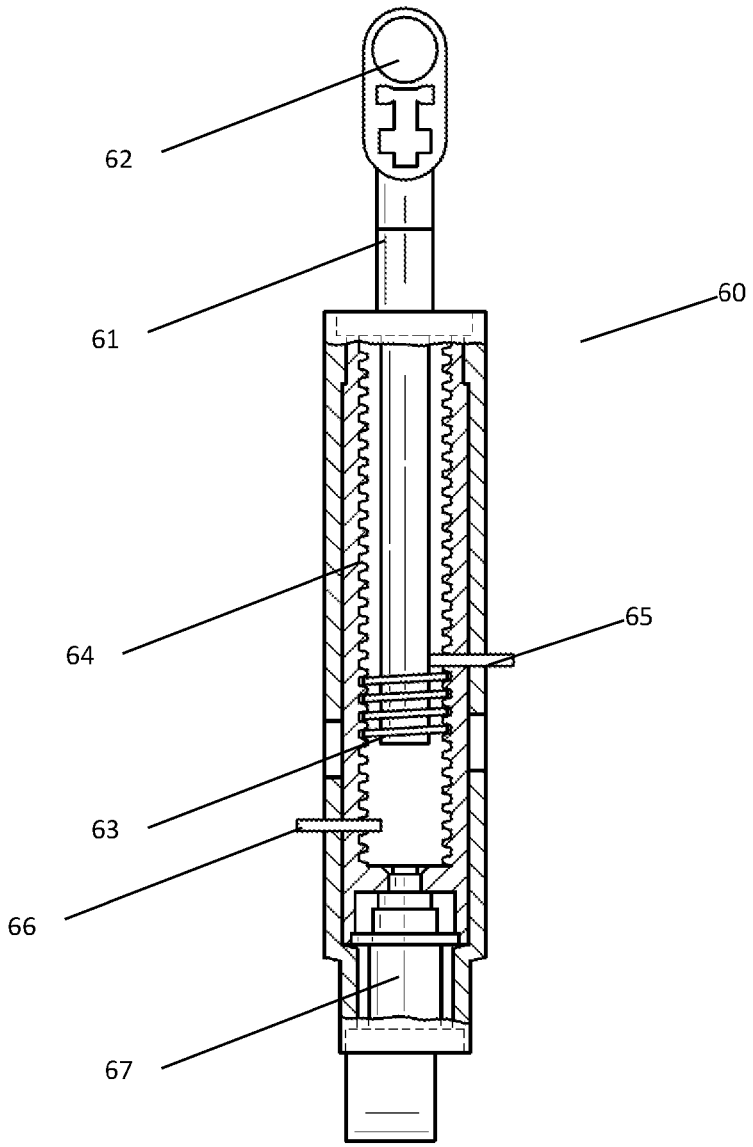

In a further embodiment of the invention comprising a linear actuator 60 comprising an electric motor 67 connected to a spindle 64 which is rotational couple to a nut 63, the nut being connected to a first end of the actuator arm 61, the second actuator arm end 62 being connectable to the limb bolt, is illustrated in FIG. 6, and is installed as the limb bolt tension amplifier 20 as shown in FIG. 2. The electric motor 67 provides the rotational force and movement to the spindle 64. When the spindle 64 rotates, the nut 63 will translate the rotational movement to linear movement of the actuator arm 61 and the actuator arm end 62. The actuator arm 61 may be the limb bolt itself, or the actuator arm end 62 may be connected to the limb bolt. The linear actuator 60 may also be arranged to have one or two stoppers 65, 66 to define a first and second end of the movement range of the piston rod 61, wherein the first stopper 65 defines a position for when the nut 63 reaches the first stopper 65 the limb bolt is in a non-tension amplifying position, and the second stopper 66 defines a position for when the nut 63 reaches the second stopper 66 the limb bolt is in a tension amplifying position.

Linear actuators come in a variety of different designs, and FIG. 6 is only one optional design that may be used in the present invention. It is within the scope of the invention to use any suitable linear actuator, substituting the one used in the example in FIG. 6.

Figure 7:
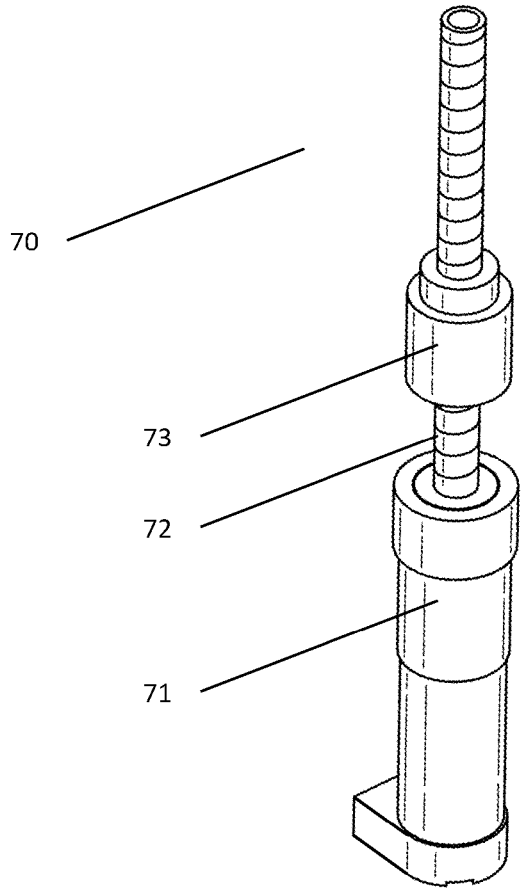

In FIG. 7 a Spindle/screw actuator 70 is shown as an even further possible limb bolt tension amplifier 20 to be used in the present invention. When using a spindle/screw actuator 70, the screw 72 is rotated by an electrical motor 71 or the like, and the nut 73 moves up and down the screw 72. The nut/actuator nut 73 is connected to the limb bolt 28, and when the electrical motor 71 rotates the screw 72, the rotational forces is translated to linear movement of the limb bolt 28 via the nut 73.

Spindle/screw actuators comes in a variety of different designs, and FIG. 7 is only one optional design that may be used in the present invention. It is within the scope of the invention to use any suitable spindle/screw actuator, substituting the one used in the FIG. 7 example.

Figure 8C:
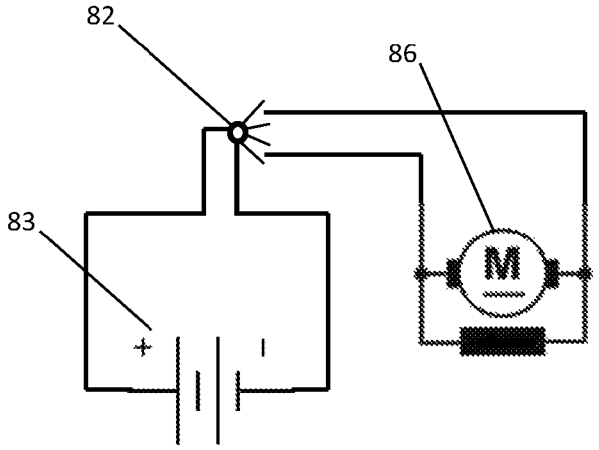

In the embodiments where an electrical motor replaces the pneumatic actuator, the valve may be replaced by a power controller/switch 82 as seen in FIG. 8C, being able to drive the motor in one direction when switch 82 is in a first position, when the switch is in a second neutral position there is no power connected to the motor, and when the switch is in a third position drive the motor in a reverse direction. The switch may be biased to be at rest in the second neutral position. The switch may further be of a momentary switch type requiring the switch to be continuously held in the first or third position to be able to feed the motor with power from the battery 83.

The valve may, in the pneumatic version of the limb bolt tension amplifier 20, further be implemented to offer a stepwise reduction valve feature, such that it can be operated to "give" pressurized gas at different pressure, for example two states where the gas can be supplied for example at either 3 or 5.0 atm. Such steps may be adjustable by a indicator on the valve, or by a selection mode on the switch. Another option is to design the switch such that the valve allow a portion of pressurized gas to flow from the accumulator 81 each time the switch is operated, such that it is possible to stepwise increase the pressure in the pressure chamber, or in the case of using a worm gear or solenoid, a stepwise movement of the limb bolt.

In one embodiment of the invention, the switch will be operated in a semi-automatic or automatic manner. One example is that the valve may be automatically switched to a relieve state when the bow string is released. This may be achieved by connecting the valve control to a fall-away arrow rest mounted on the bow riser for supporting the arrow in the draw phase. This fall-away arrow rest is connected to the cable and falls down when the arrow is released. When connected to the valve the fall-away arrow rest will be triggering the valve to switch to relieve state when it falls down after an arrow release. The valve will then, once the pressure in the pressure chamber is released, be returned to the initial state.

In a further embodiment it is provided a switch for setting the valve in a fully automatic operation mode. The fully automatic operation mode will automatically switch the valve to the load state once the bow string is drawn, and to the relieve state once the arrow is released. The switch may in this case be connected to the cable 9 movement by a detector or pilot string connection. In this operation mode the valve operation may be controlled in various manners. One is to let a tension sensor identify when the bow string is drawn, and then activate the load state of the valve. Such sensors may be arranged in the cam 11 or idler wheel 10, the string suppressor 12, roller guard 13 or on one or both limbs 2, 3. Other arrangements for detecting the arrow draw and release phase may be facilitated by the skilled person.

The semi-automatic and/or automatic operation modes may be fully mechanical or part/full electrical powered.

The limb bolt 6 controls the tension in the limb arms 2, 3 of a compound bow. The limb arm 2, 3 of the bow typically is mounted to the bow riser 1 in one end, the connection being comprised of a pivot point 7 and a limb bolt point 6. The pivot point 7 is a connection point between the limb 2, 3 and the riser 1 at which the limb 2, 3 can pivot as far as the adjustment of the limb bolt 6 allows. In the other end of the limb a cam 11 or idler 10 wheel may be arranged. The adjustment range of the limb bolt 6 may be described in the max tension required to draw the bow, i.e. 60-80 lbs. The effect of the force transferred to the limb bolt 6 when the pressure chamber 21 is provided with pressurized gas is that the bow may by set to require 60 lbs for drawing, and when the bow string 8 is drawn and let-off reduces holding effort required to for example 30 lbs, the pressurizing of the pressure chamber 21 will increase the bow string tension to increase to 80 lbs, whilst the let-off holding requirements only increases to 40 lbs.

An alternative to using pneumatic pressure arrangement in the power assisted draw weight amplifier assembly 20 is to substitute the piston and pressure chamber with a worm gear or linear actuator as shown in FIG. 5, and the piston rod with an axle. The worm gear or linear actuator may be driven by an electrical motor. In the case of electrical motor, the pressure pipes 38, 39, 40 and pneumatic accumulators 81 is replaced by wiring 38, 39, 40 and electric power accumulator, such as a battery 83. The valve function will when using a worm gear or linear actuator be replaced by a directional switch providing forward and reverse function of the worm gear or linear actuator such that for example, when the worm gear or linear actuator assembly is used in an assembly comprising the above described lever arm, the load state is represented by a forward operation of the worm gear or linear actuator to a position of the axle in an outer position, and the relieve state is represented by revers motion in the worm gear or linear actuator to a position of the axle in a retracted position.

In an alternative embodiment of using a worm gear or linear actuator wherein the axle is directly connected to the limb bolt, as in the second embodiment above, the operation of the axle is reversed such that when the power assisted draw weight amplifier assembly is in the load state, the axle is retracted, and when in the relieve state, the axle is moved to its extended position.

When an electrical motor is used in the case the power assisted draw weight amplifier assembly comprises the worm gears or linear actuators, the power source may be fed by an electrical accumulator, wherein the electrical accumulator, such as a battery 83, is connected to the bow in the same manner as described for the pneumatic accumulator above, or the electrical accumulator is remote and for example carried by the user of the bow. A connecting cable may then in a first end be attached to the accumulator, which may be a battery 83, and in the other end be connected to a connection point provided in the bow assembly. The electrical current provided by the accumulator may then be led by electrical wiring from the connecting point to the worm gears or linear actuators via the directional switch device.

The contact point may be arranged in the grip area of the bow.

The power reservoir, whether it is a gas accumulator, electrical power source or fluid accumulator may be provided in different sizes, typically customized for intended use and practical adjustments. The bigger for example the gas accumulator (cylinder) is the more times can the pressure chamber be filled without needing to change or recharge the accumulator. There is a tradeoff where size and weight is too big and will be cumbersome or unpractical for bow operation. An example of acceptable size of accumulator would be approximately 0,3 1, and max accumulator pressure 200 bar. Such reservoir would typically be enough gas for 5-20 load operations of the pressure chamber in the two cylinders of the power assisted draw weight amplifier assembly.

In the scenario where the piston acts on the lever/fulcrum, and then the limb bolt and thus provide the pull force on the limb bolt a few examples of pressure requirements to pressure in pressure chamber is listed in the table below.

TABLE II

| Draw weight (lbs) | Limb tension (lbs) | Limb lever ratio | Requirement on limb bolt (lbs) | Piston diameter (inch) | Gas pressure (bar) | Piston lever ratio | Piston work force over lever arm (lbs) |
|---|---|---|---|---|---|---|---|
| 50 | 25 | 4:1 | 100 | 1.0 | 5 | 2:1 | 110,2969 |
| 50 | 25 | 4:1 | 100 | 1.0 | 7 | 1.5:1 | 116,0014 |
| 60 | 30 | 4:1 | 120 | 1.0 | 7 | 2:1 | 154,6686 |
| 60 | 30 | 4:1 | 120 | 1.0 | 10 | 1.5:1 | 165,5718 |
| 70 | 35 | 4:1 | 140 | 1.0 | 7 | 2:1 | 220,7624 |
| 70 | 35 | 4:1 | 140 | 1.0 | 10 | 1.5:1 | 215,1422 |
| 80 | 40 | 4:1 | 160 | 1.0 | 10 | 2:1 | 110,2969 |
| 80 | 40 | 4:1 | 160 | 1.0 | 13 | 1.5:1 | 116,0014 |
| 90 | 45 | 4:1 | 180 | 1.0 | 10 | 2:1 | 110,2969 |
| 90 | 45 | 4:1 | 180 | 1.0 | 13 | 1.5:1 | 116,0014 |

The pressure chamber pressure requirements can be calculated according to formula: The force exerted by a single acting pneumatic cylinder can be expressed as $$F=pA=p\pi d^2/4 \quad (1)$$

where

F=force exerted (N)

p=gauge pressure ($N/m^2$, Pa)

A=full bore area ($m^2$)

d=full bore piston diameter (m)

1 newton is equal to 0.224808943871 pounds, and 1 newton is equal to 0.101971621 kilogram.

All the embodiments above discusses the option of using stored power to increase the tension in the limb arms by pulling the limb arm at the position of the limb bolt closer to the riser next to the limb arm at the location of the limb bolt.

A further embodiment is comprised by the invention, utilizing a cam-action controlling the limb bolt movement, and driven by the above described actuators, for example the pneumatic pressure arrangement or the worm gear to rotate the cam. The advantage with using a cam is that is will allow a defined action complete state. The cam can be designed to have a contact orbit which contacts the upper side of the limb bolt base 30, and may be substituting the resistance arm 26, and be rotating around the fulcrum in the case the actuator is a pneumatic pressure arrangement as described above and defined in FIGS. 3 and 4. In the case a worm gear is used as an actuator the cam may rotate around the center of the gear wheel.

A further embodiment, referring to FIGS. 1-2, uses the tension amplifying assembly or amplifier assembly 20 to increase the distance between the limb arms 2, 3 and the riser 1, in which the connection member or point 74 of the pivot point 7, pushes the pivot point 7 rather than pulling the limb bolt 6. In practice this comprise to mount the pivot point to a movable base being able to be moved by the piston rod/axel of the worm gear or linear actuator in a manner that when the switch is in load position the pivot point moves away from the riser thus increasing the tension in the bow string, and when the switch is in the relieve state, the pivot point is moved back towards the riser and thus relieve the tension in the bow string.

Figure 9:
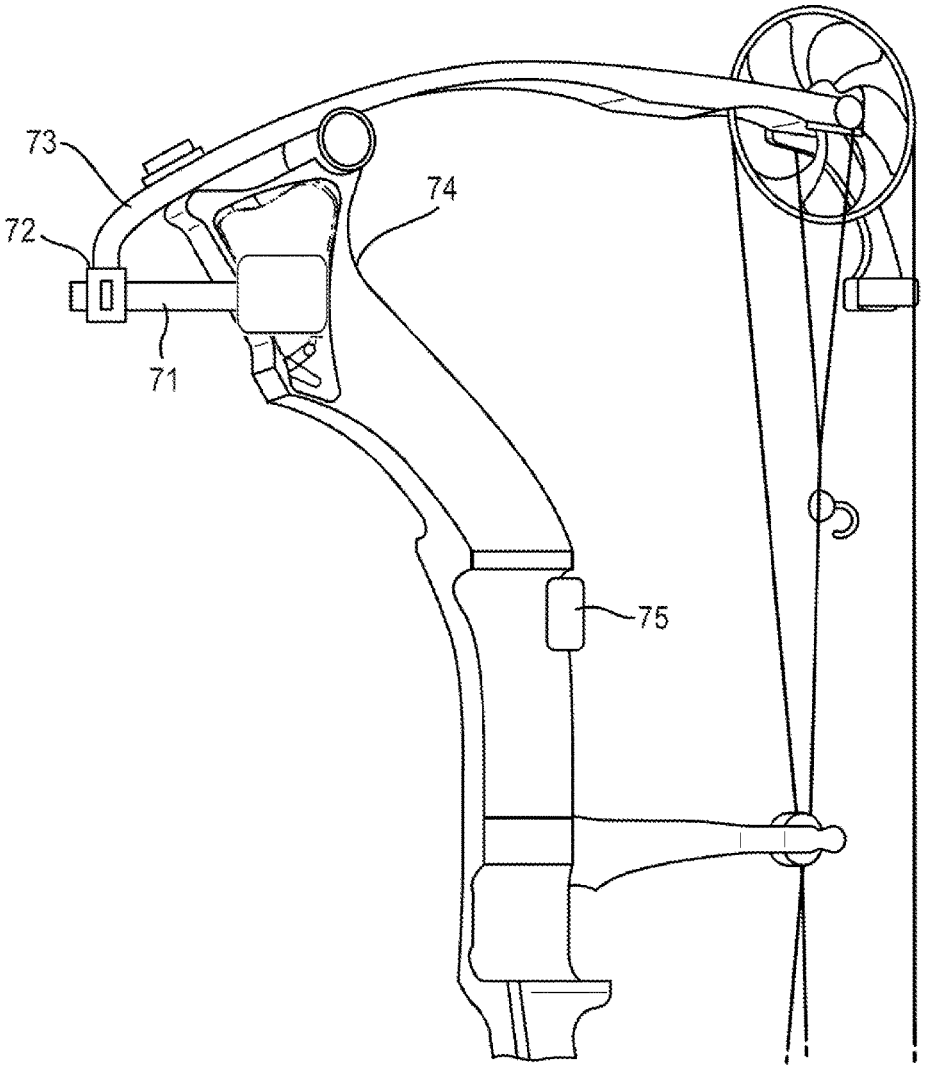

It is further provided an embodiment of the invention wherein the limb arms are extended in extensions 73 past the limb bolts 6, and the power assisted draw weight amplifier 71 is connected to the limb arm in a second limb bolt point 72 position along the extended limb arm 73. FIG. 9 outlines such an arrangement where the two limbs are extended. The two extended limbs are connected to respective single worm gear, linear actuator, or pneumatic cylinder assembly 20 as discussed above. When activated, the power assisted draw weight amplifier will pull the extended limb arm 73 in a position such that the tension in the bow string 8 increases in correspondence with the increased tension in the limb arms 2, 3.

In the event the power assisted draw weight amplifier assembly 20 is included in the production phase of the riser itself, all parts may be integrated into the riser, and the riser itself swill provide support and mounting arrangements for the different parts of the power assisted draw weight amplifier assembly 20.

In the case the power assisted draw weight amplifier assembly 20 is provided as a standalone module intended for installing when the riser is produced or being retrofitted in existing compound bow, The power assisted draw weight amplifier assembly 20 may comprise a frame 31 and attachment means 41 for attaching the power assisted draw weight amplifier assembly 20 into the riser 1. In such cases there must be provided a space in the riser close to the limb bolts, either by being provided in the production of the riser, or cut out manually in the retrofit scenario.

In the case the power assisted draw weight amplifier assembly 20 is retrofitted, it will further require that the riser be modified or arranged for mounting pipes/cabling, switch, valve, sensor and the like described above.

Now a typical user scenario will be described wherein the bow comprises a pneumatically assembly of the piston and cylinder wherein the piston rod is working the lever arm for moving the limb bolt.

When an archer is going to shoot an arrow from his compound bow 1 that comprise the present invention 20, the archer will before initiating the shooting process check the status of the accumulator 81. In the case of a pneumatic pressure accumulator 81, the task is to check the pressure status of the accumulator 81, either by reading the gauge/sensor 37 showing the pressure status of the pressure accumulator 81, or by taking a toll of how many load cycles have been performed since refilling, or mounting of the accumulator 81. When satisfied that there is at least enough pressure/power for another shooting cycle, the archer will initiate a shooting sequence by arranging an arrow in the bow 1. When a shooting target is approached, the archer will draw the bow 1 pulling the arrow and bowstring 8 back until it is fully drawn, and the cam 11 and idler wheel 10 will reach the let off position, making it easier for the archer to hold the drawn stance. When the archer are considering the shot is close he will activate the switch 82 opening up for pressurized air/gas to flow from the pneumatic accumulator 81 to the cylinders 22 of the power assisted draw weight amplifiers 20. When the switch 82 is activated, the gas/air will pass through a pressure reduction valve 87 to adapt the pressure for its required pressure level to the cylinder 33/piston 22 operation. When the pressure increase in the cylinder 33, the piston 22 will move from a first position where the bow string 8 is in a non-tension amplifying position to a second position where the bow string 8 is in a tension amplifying position. The movement of the piston 22 will rotate the lever arm since the effort arm 25 is connected to the end of a piston rod 23 connected to the piston 22. In the other second end of the lever arm, the resistance arm 26 is connected to the limb bolt base 30 of the limb bolt 28 which protrudes into the bow riser 1. The lever arm rotates around a fulcrum 27 (pivot point) such that when the effort arm 25 is moved away from the pressure chamber 21 by the piston 22 and piston rod 23 when the pressure in the pressure chamber 21 increases, the resistance arm 26 will act on the limb bolt base 30 and exert a pulling force on the limb bolt 28, 6. The ratio between the effort arm and the resistance arm defines the force amplification from the force applied by the cylinder rod effective on the limb bolt. When the limb bolt is moved towards the riser, the tension in the limb arms increase, and the tension in the bow string is further increased. The holding force required by the archer for the extra force added to the draw is at the same let off ratio as for the initial draw phase. If the initial draw requires 50 lbs and the let off is 50% will mean that the archer needs to exert a holding force of 25 lbs. When the switch is activated and the invention brings the bow to a tension amplifying state, the arrow string tension is increased to for example 70 lbs, but the let off will mean that the holding force will only increase by 50% of the additional string tension. The holding force of the 70 lbs draw therefore is only 35 lbs. The optional sensor and sensor light 75 will for example switch from red to green light when the limb bolt is in its maximum tension position, and the archer know that he has full tension in the bow string. In the case of a fall-away arrow rest is comprised in the bow setup, and where it is setup to control the valve in the release stage when the bow is configured with a pneumatic power assisted draw weight amplifier assembly 20, when the archer fires the arrow the fall-away arrow rest will turn the valve to a position where the valve closes the accumulator inflow, and opens up the channel from the cylinders to the relief reservoir 85 or free air. In the latter position the cylinder will move back to its initial position by the force originating from the setup tension in the bow string and limb arms which bias the limb bolt in a direction away from the riser. This force is then transferred to the lever arm which in turn will move the piston back to its starting position.

The invention shall also be recognized by the following advantageous embodiments where there is in a first embodiment a compound bow comprising:

- a riser 1,
- a first top limb 2 arranged at a first end of the riser 1,
- a second bottom limb 3 arranged at the opposite second end of the riser 1, wherein the top and bottom limbs 2, 3 are attached to the riser 2 in a pivot point 7 and, in a first end of the top and bottom limbs 2, 3, a limb bolt point 6,
- a bow string 8 conned to the second end of the top and bottom limbs 2,3,
- a power assisted draw weight amplifier assembly 20 integrated in the riser 1 adjacent the limb bolt point 7 in the top limb 2,
- a power assisted draw weight amplifier assembly 20 integrated in the riser 1 adjacent the limb bolt point 7 in the bottom limb 3,
- the power assisted draw weight amplifier assemblies 20 comprising a limb bolt 28, the limb bolt 28 comprising in a first end a limb bolt head 29, the limb bolt head 29 being arranged in the limb bolt point 6 to inflict or restrict movement of the limb bolt points 6 of the top and bottom limbs 2, 3 relative the riser 1, such that a tension in the top and bottom limbs 2, 3 can be increased or decreased when the bow string 8 has been drawn.

A second embodiment of the compound bow according to the first embodiment, wherein the second end of the limb bolt 28 comprise a limb bolt base 30 and the limb bolt base 30 is connected to an actuator arm 25, 26, 27, 51*a*, 51*b*, 61, 73 of the power assisted draw weight amplifier assembly 20, the actuator arm is movable by an applied force to move the limb bolt head 29 relative to the riser, and thereby increase or decrease the bow string tension.

A third embodiment of the compound bow according to the second embodiment, wherein the actuator arm 25, 26, 27 is comprised of a lever arm 25, 26, 27, the lever arm comprises a resistance arm 26, an effort arm 25 and a fulcrum 27 wherein the lever arm in a first outer end of the lever arm, the effort arm 25, is connected to the end of a piston rod 23 which is connected to a piston 22, wherein the piston 22 is arranged in a cylinder 33 forming a pressure chamber between the cylinder top surface and the cylinder bottom wall 34, wherein the piston 22 is driven by an applied pneumatic pressure in the pressure chamber 21 of the cylinder 33, and in the other second end of the lever arm, the resistance arm 26 is connected to the limb bolt base 30 of the limb bolt 28 which protrudes into the bow riser 1, such that when the piston 22 is moved due to the changed pressure in the pressure chamber 21, the lever arm 25, 26, 27 rotates around the fulcrum 27, and the resistance arm 26 move the limb bolt 28 in the opposite direction of the cylinder movement at a ratio equal to the ratio between the length of the resistance arm 26 and the effort arm 25.

A fourth embodiment of the compound bow according to the second embodiment, wherein the actuator arm 23 which is connected to a piston 22, wherein the piston 22 is arranged in a cylinder 33 forming a pressure chamber 35 between the cylinder top surface and the cylinder top 32, wherein the piston 22 is driven by an applied pneumatic pressure in the pressure chamber 35 of the cylinder 33, and the cylinder rod 23 is connected in one end to the piston 22 and in the opposite end connected to the limb bolt base 30 of the limb bolt 28 which protrudes into the bow riser 1, such that when the piston 22 is moved due to the changed pressure in the pressure chamber 21, the limb bolt 28 is moved correspondingly in the same direction and distance as the cylinder movement.

A fifth embodiment of the compound bow according to the third or fourth embodiment, further comprising a pressure accumulator 81, a pipe assembly 38, 39, 40, a valve 80 and a switch 82, wherein the pipe assembly connects the pressure accumulator 81 to the pressure chambers 21, 35 via the valve 80 controlling the pressure output from the pressure accumulator 81 to the pipe assembly 38, 39, 40 and the switch 82 controlling the flow rate and direction in the pipe assembly 38, 39, 40.

A sixth embodiment of the compound bow according to the second embodiment, wherein the actuator arm 51*a*, 51*b* is connected to a gear wheel 59 of a worm gear 50, the worm gear being driven by a motor 54, wherein worm gear is arranged to move the actuator arm between a first 51*a* and a second position 51*b* wherein the first position 51*a* is a non-tension amplifying position and the second postilion 51*b* is a tension amplifying position and is arranged to be at the return side of a center line 55 of the gear wheel 59, wherein the worm gear 50 is driven by electric power, actuator arm 51*a*, 51*b* is connected in one end to the gear wheel 59 and in the opposite end connected to the limb bolt base 30 of the limb bolt 28 which protrudes into the bow riser 1, such that when the gear wheel 59 is moved due to the applied electric power, the limb bolt 28 is moved correspondingly in the linear direction and corresponding distance as the actuator arm's 51*a*, 51*b* connection point on the rotating gear wheel 59.

A seventh embodiment of the compound bow according to the second embodiment, comprising a linear actuator 60 wherein an actuator arm 61 is coupled to a spindle 64 through a nut 63, the nut being connected to a first end of the actuator arm 61, the spindle 64 being rotated by a motor 67, wherein the spindle 64 is arranged to move an actuator nut 63 between a first stopper 65 and a second stopper 66 wherein the first stopper 65 identifies a non-tension amplifying position and the second stopper 66 identifies a tension amplifying position, wherein the motor 67 is driven by electric power, the actuator arm 61 is connected in the second end to the limb bolt base 30 of the limb bolt 28 which protrudes into the bow riser 1, such that when the motor 67 is driven due to the applied electric power, the limb bolt 28 is moved correspondingly in the same direction and distance as the actuator arm 61 is driven by the transitional movement transferred by the nut 63 being moved by the rotating spindle 64.

An eight embodiment of the compound bow according to the sixth or seventh embodiment, further comprising a power accumulator 81, an electric wiring assembly 38, 39, 40, a power controller 80 and a switch 82, wherein the electric wiring assembly connects the power accumulator 81 to the motor 54, 67 via the power controller 80 controlling the power output from the power accumulator 81 to the electric wiring assembly 38, 39, 40 and the switch 82 controlling the current rate and direction in the electric wiring assembly 38, 39, 40.

A ninth embodiment of the compound bow according to the fifth or eight embodiment, wherein the switch 82 has at least two switch positions controlling the flow of energy between the accumulator 81 and the power assisted draw weight amplifier assembly 20, wherein a first switch position identify transfer of power from the accumulator 81 to the power assisted draw weight amplifier assembly 20, such that the actuator arm 25, 26, 27, 51*a*, 51*b*, 61, 73 is moved to a tension amplifying position, and a second switch position identify cut-off or reversing transfer of power from the accumulator 81 to the power assisted draw weight amplifier assembly 20, such that the actuator arm 25, 26, 27, 51*a*, 51*b*, 61, 73 is moved or movable to a non-tension amplifying position.

A tenth embodiment of the compound bow according to any of the first to ninth embodiment, further comprising one or more sensors 37 for sampling of bow string tension, switch 82 positions and valve 80 status, power levels where power level being one of gas/fluid pressure level or electrical power level at accumulator 81 and/or the power assisted draw weight amplifier assembly 20.

An eleventh embodiment of the compound bow according to tenth embodiment, further comprising one or more identification lights 75, wherein the one or more identification lights 75 have at least two states identifying one or more of: maximum bow string tension reached, bow string tension released, accumulator sufficiently charged, accumulator level to low, poor shooting light, switch position.

A twelfth embodiment of the compound bow according to tenth embodiment, further comprising a data storage for reading and storing the sensor sampling values.

An thirteenth embodiment of the compound bow according to twelfth embodiment, further comprising a data transfer interface for transferring data stored in the data storage to a remote computer or display unit.

A fourteenth embodiment of the compound bow according to any of the first to thirteenth embodiment, wherein the power assisted draw weight amplifier assembly 20 further comprise a frame 31 and attachment means 41 for attaching the power assisted draw weight amplifier assembly 20 into the riser 1 when the power assisted draw weight amplifier assembly 20 is retrofitted into a riser 1 of a compound bow.

A fifteenth embodiment of the compound bow according to any of the first to fourteenth embodiment, wherein the accumulator 81 is connected to the riser 1 in a connection point 19 close to the grip section 16.

A sixteenth embodiment of the compound bow according to any of the eighth to fifteenth embodiment, wherein the riser 1 further comprise a fall-away arrow rest, wherein the fall-away arrow rest is coupled to the switch 82 such that when the fall-away arrow rest falls down as a result of an arrow release, the switch 82 is triggered to move from the first switch position to the second switch position.

The invention shall also be recognized by the following advantageous method embodiment where there is in a first method embodiment a method for retrofitting power assisted draw weight amplifier assemblies 20 into a compound bow according to any of the first to sixteenth embodiment of the compound bow, the method comprising the steps:

removing riser material to create sufficient space for the power assisted draw weight amplifier assembly 20 to be mounted adjacent the limb bolt;

replace the limb bolt with limb bolt comprising connection means for connecting to the actuator arm 25, 26, 27, 51*a*, 51*b*, 61, 73 of the power assisted draw weight amplifier assembly 20;

mount the accumulator 81 to the riser;

mount switch 82 and power lines, or a pipe assembly 38, 39, 40, a valve 80 and a switch 82, valves between the accumulator 81 and the power assisted draw weight amplifier assembly 20.

The following is claimed:

1. A tension amplifying assembly comprising:

a plurality of pivot points, wherein each of the pivot points is configured to be moveably coupled to one of a plurality of limbs of an archery bow;

a plurality of connection members configured to be coupled to a frame of the archery bow, wherein:

the archery bow comprises a bow string coupled to the limbs; and each of the connection members is configured to move one of the pivot points that is coupled to one of the limbs so that the one of the limbs is pivotal from a first position relative to the frame to a second position relative to the frame;

a plurality of piston-cylinder assemblies configured to be coupled to the archery bow, wherein:

each of the piston-cylinder assemblies is configured to be operatively coupled to one of the connection members; and each of the piston-cylinder assemblies comprises a pressure chamber and a piston rod;

at least one gas reservoir tillable with a gas, wherein the at least one gas reservoir is configured to be fluidly connected to the pressure chambers;

at least one valve configured to be fluidly connected to the at least one gas reservoir; and a switch device configured to be operatively coupled to the at least one valve, wherein the connection members are configured to cause the limbs to move from the first positions to the second positions in response to an operation of the switch device, wherein the movements to the second positions cause a tension in the bow string to increase to a tension level.

2. The tension amplifying assembly of claim 1, wherein:

the frame comprises a riser, and the archery bow comprises a compound bow.

3. The tension amplifying assembly of claim 1, wherein:

the tension level comprises a second tension level; and the switch device is operable in a plurality of states comprising a relief state and a load state, wherein, when the switch device comprises the relief state, the connection members are configured to enable the limbs to comprise the first positions, which enables the tension to comprise a first tension level, wherein, in response to the switch device being changed to the load state, the connection members are configured to cause the limbs to pivot to the second positions, wherein the pivoting of the limbs to the second positions causes the tension to comprise the second tension level that is greater than the first tension level.

4. The tension amplifying assembly of claim 3, wherein:
each of the connection members is coupled to one of the pivot points;
the connection members are configured to cause each of the pivot points to move away from the frame in response to the switch device being changed to the load state;
the connection members are configured to cause each of the pivot points to move toward the frame in response to the switch device being changed to the relief state; and
the second tension level is sufficient to enable the bow string to launch a projectile to shoot a target.

5. The tension amplifying assembly of claim 1, comprising one or more supply lines configured to fluidly connect the at least one gas reservoir to the pressure chambers, wherein at least part of the one or more supply lines is configured to be positioned within a cavity defined by the archery bow.

6. The tension amplifying assembly of claim 1, comprising a muffler operatively coupled to the at least one valve.

7. The tension amplifying assembly of claim 1, comprising a silencer operatively coupled to the at least one valve.

8. The tension amplifying assembly of claim 1, wherein:
the at least one gas reservoir is configured to be detached from the archery bow; and
the at least one gas reservoir comprises a container that comprises a threaded portion.

9. The tension amplifying assembly of claim 1, wherein:
the gas is pressurized within the at least one least one gas reservoir so as to cause a force;
the force affects the second positions, which affects the tension; and
the tension amplifying assembly comprises a regulator configured to adjust a magnitude of the force, which adjusts the tension.

10. The tension amplifying assembly of claim 9, wherein the regulator comprises a gas volume output regulator fluidly connected to the at least one gas reservoir.

11. The tension amplifying assembly of claim 1, wherein:
the gas is pressurized within the at least one least one gas reservoir so as to cause a force;
the force affects the second positions; and
the tension amplifying assembly comprises a reduction device configured to reduce a magnitude of the force, which adjusts the tension.

12. An archery bow comprising the tension amplifying assembly of claim 11.

13. A tension amplifying assembly comprising:
a plurality of pivot points, wherein each of the pivot points is configured to be moveably coupled to one of a plurality of limbs of an archery bow;
a plurality of connection members configured to be coupled to a structure of the archery bow, wherein:
the archery bow comprises a bow string coupled to the limbs; and
each of the connection members is configured to move one of the pivot points that is coupled to one of the limbs so that the one of the limbs is movable from a first position relative to the structure to a second position relative to the structure;
a plurality of piston-cylinder assemblies configured to be coupled to the archery bow, wherein each of the piston-cylinder assemblies is configured to be operatively coupled to one of the connection members;
at least one reservoir fillable with a fluid, wherein the at least one reservoir is configured to be fluidly connected to the piston-cylinder assemblies;
at least one valve configured to be fluidly connected to the at least one reservoir; and
a switch device configured to be operatively coupled to the at least one valve,
wherein the connection members are configured to cause the limbs to move from the first positions to the second positions in response to an operation of the switch device,
wherein the movements to the second positions cause a tension in the bow string to increase.

14. The tension amplifying assembly of claim 13, wherein:
each of the connection members is coupled to one of the pivot points;
the connection members are configured to cause each of the pivot points to move away from the structure in response to the switch device being changed to a load state:
the connection members are configured to cause each of the pivot points to move toward the structure in response to the switch device being changed to a relief state; and
the movements of the pivot points cause the tension to increase to a tension level; and
the tension level is sufficient to enable the bow string to launch a projectile to shoot a target.

15. The tension amplifying assembly of claim 13, comprising one or more supply lines configured to fluidly connect the at least one reservoir to the piston-cylinder assemblies, wherein at least part of the one or more supply lines is configured to be positioned within a cavity defined by the archery bow.

16. The tension amplifying assembly of claim 13, wherein:
the tension amplifying assembly comprises a silencer operatively coupled to the at least one valve;
the at least one reservoir is configured to be detached from the archery bow; and
the at least one reservoir comprises a container that comprises a threaded portion.

17. The tension amplifying assembly of claim 13, wherein:
the fluid is pressurized within the at least one reservoir so as to cause a force:
the force affects the second positions; and
the tension amplifying assembly comprises a regulator configured to adjust a magnitude of the force.

18. The tension amplifying assembly of claim 17, wherein the regulator comprises a fluid volume output regulator fluidly connected to the at least one reservoir.

19. An archery bow comprising the tension amplifying assembly of claim 13.

20. A method for manufacturing a tension amplifying assembly, the method comprising:
configuring each one of a plurality of pivot points to be coupled to one of a plurality of limbs of an archery bow;
configuring a plurality of connection members to be coupled to a structure of t archery bow, wherein:
the archery bow comprises a bow string coupled to the limbs; and
each of the connection members is configured to move one of the pivot points that is coupled to one of the limbs so that the one of the limbs is movable from a first position relative to the structure to a second position relative to the structure;

obtaining a plurality of piston-cylinder assemblies that are configured to be coupled to the archery bow, wherein each of the piston-cylinder assemblies comprises a piston rod configured to be operatively coupled to one of the connection members;

obtaining at least one reservoir fillable with a fluid, wherein the at least one reservoir is configured to be fluidly connected to the piston-cylinder assemblies;

obtaining at least one valve configured to be fluidly connected to the at least one reservoir; and obtaining a switch device configured to be operatively coupled to the at least one valve, wherein the connection members are configured to cause the limbs to move from the first positions to the second positions in response to an operation of the switch device, wherein the movements to the second positions cause a tension in the bow string to increase.

* * * * *